US005275484A

United States Patent [19]

Shohet

[11] Patent Number: 5,275,484

[45] Date of Patent: Jan. 4, 1994

[54] APPARATUS FOR CONTINUOUSLY PROCESSING LIQUIDS AND/OR SOLIDS INCLUDING MIXING, DRYING OR REACTING

[75] Inventor: Albert J. Shohet, Cincinnati, Ohio

[73] Assignee: Processall, Inc., Cincinnati, Ohio

[21] Appl. No.: 754,399

[22] Filed: Sep. 3, 1991

[51] Int. Cl.[5] ..... B01F 15/02

[52] U.S. Cl. ..... 366/132; 366/149; 366/155; 366/196

[58] Field of Search ..... 366/279, 14, 15, 149, 366/176, 307, 293, 295, 296, 132, 155, 196

[56] References Cited

U.S. PATENT DOCUMENTS

| | | | |
|---|---|---|---|
| 2,029,688 | 2/1936 | Wilson | 366/176 |
| 3,617,225 | 11/1971 | Kuehne | 366/149 |
| 3,897,218 | 7/1975 | Busweiler . | |
| 3,970,288 | 7/1976 | Brooks . | |
| 4,126,398 | 11/1978 | Phillips et al. . | |
| 4,599,004 | 7/1986 | Keith | 366/176 |
| 4,630,930 | 12/1986 | Seiling . | |

OTHER PUBLICATIONS

Plate Dryer TT, Plate Cooler TK, Krauss Maffei, Verfahrenstechnik GmbH pp. 2-5 (no date).

*Primary Examiner*—Robert W. Jenkins

*Attorney, Agent, or Firm*—Antonelli, Terry, Stout & Kraus

[57] ABSTRACT

An apparatus (10) with a central shaft (32) equipped with single or multiple-mixing elements (36) projecting perpendicularly from the shaft. Multiple processing zones (14–18) have adjustable openings (24) for introducing the product through adjacent processing zones for thermal treatment or conducting thermal reactions. A heating or cooling jackets (63 and 129) permits thermal control of the processing within the chamber. Additional thermal treatment can be achieved with microwave, infrared, hot gas or other available heating or cooling sources. The chamber is closed during vacuum or pressure processing by using rotary locks or double valving. A controlled dwell time in the chamber is accomplished with the adjustment of the opening of the weirs. The rotational velocity of the elements plays a major role in maintaining the material in the desired processing zone or causing advancement between adjacent zones. Continuous non-atmospheric pressure can be maintained without exposing vapors or product to atmospheric conditions by means of providing valving in the material input and material output. Chopping mills, pre-wetting devices and liquid/solid vacuum filtration can be added to enhance the function of the equipment. Processing may be extended in time with two or more apparatus connected in series or in parallel to provide additional processing capability.

25 Claims, 5 Drawing Sheets

APPARATUS FOR CONTINUOUSLY PROCESSING LIQUIDS AND/OR SOLIDS INCLUDING MIXING, DRYING OR REACTING

TECHNICAL FIELD

The present invention relates to apparatus and methods for continuously processing materials including mixing, drying or reacting.

BACKGROUND ART

Continuous vacuum dryers designed with rotating shelves have been available on the market for several decades. Krauss Maffei of Germany markets a continuous vacuum dryer. This device has a plurality of plates mounted on a vertical shaft. Wet product is fed from a feeder unit which may be under vacuum or pressure onto the uppermost plate. Product is plowed across the plate by a rotating transport arm. The product is plowed across the plate by the rotating transport arm in the form of a ridge extending toward an outer edge of the plate. The product falls onto the next plate below. The foregoing process is repeated as many times as there are plates. Dry product is discharged from the plate dryer. This device has limitations in that it is large in size. Heat transfer, efficiency, ease of cleaning and troubleshooting are limited due to size and slow operational speeds. Clean-up before changing products can be a major cost. Furthermore, the cost of maintaining non-atmospheric pressure such as vacuum can be substantial due to the multiple shelves and large seals required to accomplish this job. Products having a high moisture content such as slurries cannot be efficiently dried.

U.S. Pat. No. 3,897,218 discloses a polycondensation reactor mounted within a horizontal drum. A plurality of partitions divide a series of drums which are mounted within the outer drum which are rotated by a shaft. The partitions define the level of liquid in each drum. The rate of flow of product between drums is controlled by the partitions. The speed of the shaft is not varied to control a rate of flow between the drums or a dwell time within each drum.

DISCLOSURE OF THE INVENTION

The present invention is a continuous processing device and method of processing for processing liquids and/or solids (materials) including the operations of mixing, drying or reacting of the materials. At least one weir is mounted within a chamber with multiple processing zones being disposed on both sides of a weir within the chamber. A rotatable shaft extends axially through the chamber on which is mounted at least one element which contacts the materials within each of the zones. The elements may be of different configurations including flat blades or plow-like blades. An opening extends vertically upward from a weir within the chamber for permitting materials to pass from one zone to an adjacent zone. A prime mover rotates the shaft under the control of a controller for controlling a rate of rotation of the shaft by the prime mover for controlling contact of the elements with the materials and a rate of movement of the materials through the opening between the zones and axially within a zone. A controller may be programmed to provide a constant rate of rotation of the shaft which produces a constant feed rate of processed materials between the zones. Alternatively, the rate of rotation of the shaft to provide available rate of rotation of the shaft over programmed time intervals. The controller may be programmed to provide a slower rate of rotation producing a longer dwell time of materials within each of the zones and a lower rate of movement of the materials through the opening between zones and a higher rate of rotation of the shaft when compared to the lower rate of rotation which produces a higher rate of movement of the product through the opening between zones and a shorter dwell time within zones. The appropriate choice of timed intervals of rotation of the shaft with different rates of rotation permits the processing of materials to be continuously processed at a fixed rate of processing of feeding materials between the zones or to be processed for longer periods of time within each zone followed by shorter periods of feeding product between the zones. Programs may be stored in the programmed controller for processing particular mixtures of materials which may be selected by an operator to provide efficient processing for diverse types of materials without requiring substantial operator programming.

A number of independent variables control the flow rate of material between zones. The openings which extend above the weirs are adjustable in cross section either manually or by an externally powered actuator to control the rate of feeding processed materials between zones, also may be controlled by programming of the opening to permit shorter or longer dwell times of materials which are processed within each zone. The number and form of elements within each zone which contact the material within the zone during rotation of the shaft may be varied to change flow of materials between zones. The rotational velocity of the shaft may be increased to propel the material between zones. A reduced rotation velocity of the shaft provides agitation without moving the material across the weirs between zones.

The mixing apparatus and method of processing may be varied to accommodate diverse applications. A material input and material output are respectively connected to a first zone of the chamber which receives material to perform initial processing of materials and the final zone in the chamber which performs final processing of materials within the chamber.

The processing provided by the invention may be controlled by a number of variables. The design and orientation of the elements mounted on the rotatable shaft can be varied to control retention time. The number of compartments may be increased to provide adequate drying or reacting zones to prevent material short circuiting or escape without being adequately thermally treated. The opening between the zones may be adjusted to provide slower or faster transfer of material between compartments. The rate of rotation of the elements may be increased or decreased to adjust the transfer rate of materials between zones. The frequency of charging and discharging material with gating interlocks may be increased or decreased. The chamber may be held at controlled pressures above or below atmospheric pressure to provide diverse types of processing.

The present invention may be configured in the form of a continuous vacuum dryer/reactor which is equipped with multiple cutting or milling devices which are located perpendicular to the axis of rotation of the shaft extending through the zones. Agglomerates are broken down to expose particles to a heat transfer surface. A typical dryer/reactor may have agglomerates formed when the moisture level within one of the zones reaches a predetermined value. The size of the agglomerates may be too large requiring further size reduction. Alternatively, it may be necessary to add moisture to promote agglomeration to reduce dust and provide easier material handling.

The present invention may be used to densify product by adding liquid ingredients and thereafter gently drying the product mixture including the liquid ingredient. A wet granulation section may be disposed in a material input to provide processing of dry powders.

A temperature control jacket may be utilized to heat the walls of the chamber or the dividing weirs to provide heating or cooling of the materials being processed therein. Individual jackets may be provided for each zone to create the desired thermal conditioning which is needed. Exothermic reactions can be controlled when the walls of the chamber are cooled. Alternatively, other heating sources may be used such as electrical heating coils, steam, hot oil, infrared or microwave heating devices. Cooling may be accomplished with chilled water, super-chilled solvents to control exothermic reactions or by inducing cooling gasses.

Access to the chamber is made through doors or covers depending upon the size of the chamber and the product being processed. Chamber access permits the processing elements to be changed to permit processing of diverse types of products and efficient clean-up between processings.

Each zone may be provided with specially designed observation ports to view the product during processing stages. Each port may be provided with a special gas or fluid jet pulsing to clear the viewing and to prevent accumulation of powder or vapors.

Non-atmospheric pressure may be maintained within the chamber by providing appropriate valving in the material input and material output. The valving may take the form of a pair of valves connected in series in the material input and the material output which are sequentially opened under the control of a controller such that one of the valves is always closed to the atmosphere during the addition of material to the first processing stage and the removal of material from the last processing stage. Alternatively, single valves such as rotary airlocks may be used in the material input and the material output to maintain non-atmospheric pressure within the zones.

A pulse-back filter may be attached directly to the chamber to remove vapors from the product being processed within the zones. The vapor may be condensed and recovered for re-use or disposal.

The present invention provides the following processing capabilities. Continuous processing of materials within a series of horizontally disposed zones including processing such as mixing, vacuum drying under reduced atmospheric pressure conditions or reacting materials for conducting chemical reactions under increased atmospheric pressure. The invention provides a mechanical fluid bed which permits multiple processing such as mixing, drying or reacting. A high coefficient of heat transfer is produced as a result of improved surface contact of the materials which are processed with the walls of the chamber. The invention permits the processing of materials having variable viscosities. The materials may range from low solid slurries, paste, pseudo-plastics, dense granular solids all the way to fine powders. The processing may be accomplished continuously without environmental exposure as a consequence of pressure sealing of the chamber from the atmosphere which provides product containment. The invention permits diverse types of processing to be produced within the zones of the chamber with controllable dwell time within each zone for the purpose of achieving varied processing. The present invention is compact in size and permits interfacing with other process machinery. The present invention is energy-efficient an provides efficient drying and an efficient reaction system. Minimal human intervention is required to operate the present invention in view of the programmability of the control of the processing produced by the invention. The invention permits quick access to the inside of the chamber for inspection, maintenance and cleaning. The invention saves operator process time due to reduced product handling. As a consequence of the continuous processing, no time is wasted for charging, discharging or sampling the product. The cost of the present invention is reduced as a result of the simplicity of the machinery and the compactness which saves space. The programmability provides the ability for complete automation which provides enhanced quality control. The adjustable openings between the processing zones permit isolation of product processing zones. The invention permits coupling to other auxiliary components such as a continuous vertical granulator/agglomerator in the material input to provide added processing capability and may be connected in series or parallel with other pieces of equipment to reduce additional processing steps.

An apparatus for continuously processing materials including mixing, drying or reacting, in accordance with the invention includes a chamber containing a plurality of axially separated processing zones in which the materials are processed and through which the materials are axially moved between the zones, the zones being defined by an inner wall of the chamber and at least one weir with a weir being disposed at a boundary between zones within the chamber, and an opening extending vertically upward from a weir within the chamber for permitting the materials to pass from one zone to an adjacent zone; a shaft extending through the zones having a plurality of radially extending elements for contacting the materials within the zones with rotation of the shaft causing the materials within the zones to be contacted by the elements and axially moved through the opening between zones; a prime mover for rotating the shaft; and a controller for controlling a speed of rotation of the shaft by the prime mover for controlling contact of the elements with the materials and movement of the materials through the opening between the zones and axially within a zone. The controller may control the rate of rotation of the shaft to produce a programmed rate of contact of the elements with the materials and a programmed rate of movement of the materials through the opening between the zones and axially within a zone. The chamber is preferably cylindrical with the shaft being mounted axially within the chamber.

Further, in accordance with the invention, a material input controls feeding of materials into a first zone of the chamber which receives the materials with the elements contacting the materials in the first zone to perform initial processing of the materials within the chamber and a material output controls feeding of materials from a final zone in the chamber in which the elements contact the materials to perform final processing of the materials within the chamber. The material input and the material output may respectively comprise a pair of valves coupled in series in the material input and in the material output. The pair of valves in the material input are opened and closed under the control of the controller to control movement of the materials through the material input into the first zone and the pair of valves in the material output are opened and closed under the control of the controller to control movement of the processed materials from the final zone. Alternatively, the material input and material output respectively comprise a rotary airlock controlled by the controller with the rotary airlock in the material input controlling movement of the materials through the material input into the first zone and the rotary airlock in the material output controlling movement of the materials from the final zone. The chamber and the material input and material output have seals to permit maintenance of non-atmospheric pressure within the chamber, material input and material output. Furthermore, a source of non-atmospheric pressure is coupled to the chamber for maintaining the chamber at non-atmospheric pressure during processing of materials within the chamber.

A lower valve in the material input may be controlled by the controller to be closed while an upper valve in the material input is controlled by the controller to be opened to seal the chamber from atmospheric pressure during conveying of materials by the material input for addition to the first zone. Thereafter, the upper valve of the material input is closed by the controller to seal the material conveyed by the material input from atmospheric pressure between the lower and upper valves. Finally, the lower valve of the material input is opened by the controller to cause the material between the lower and upper valves to be added to the first zone.

A lower valve in the material output is controlled by the controller to be closed while an upper valve in the material output is opened during discharge of materials from the first zone. Thereafter, the upper valve in the material output is closed by the controller to seal the discharged liquids between the valves from atmospheric pressure. Finally, the lower valve of the material output is opened to cause the material between the lower and upper valves to be moved from between the valves.

The rotary airlock of the material input is rotated by the controller to retain materials within the material input while the material is coupled to atmospheric pressure and the material input between the rotary airlock and the first zone is at non-atmospheric pressure and the rotary airlock of the material input is rotated by the controller to convey liquids and/or solids to the material input between the rotary airlock and the first zone while sealing the material input between the rotary airlock and the first zone from atmospheric pressure.

The rotary airlock of the material output is rotated by the controller to retain materials within the material output while the material output between the final zone and the rotary airlock of the material output is coupled to non-atmospheric pressure and the rotary airlock of the material output is rotated by the controller to convey the materials within the rotary airlock of the material output to atmospheric pressure while sealing the material output between the final zone and the rotary airlock of the material output to non-atmospheric pressure.

Further in accordance with the invention an apparatus for agglomerating and/or granulating solids flowing through the material input may be added within the material input.

The opening between zones comprises a gate having a movable member which is moved by an adjustment mechanism to vary a cross section of the opening between adjacent zones. The chamber further comprises a removable lid which, when open, exposes the zones; and wherein the adjustment mechanism is disposed within the chamber and the cross section of the opening is varied by a member within the chamber which is moved by access through the removed lid. Alternatively, the adjustment mechanism comprises a fluid actuator which receives power from outside the chamber with the opening being varied by controls disposed outside the chamber.

A filtration screen is disposed in a section of at least one of the zones for permitting liquid separation of liquids from solids disposed within the zones by the liquid flowing through the screen outside the chamber.

The invention further includes a jacket surrounding at least a part of the chamber for receiving fluid for controlling temperature of the walls of the chamber.

The invention further includes at least one fluid spraying device mounted in a wall of the chamber for spraying processing fluid inside the chamber or for spraying cleaning fluid within the chamber.

An agitator is disposed within the final zone for contacting the materials to cause the materials to flow into the material output. The agitator may comprise an eccentric rotatably mounted on the shaft which is connected to a member extending into the material output with rotation of the eccentric causing the member to reciprocate within the material output.

The controller is programmable to provide a programmed processing of materials including control of a dwell time of the materials within each zone and a rate of movement of the materials through the opening between the zones. The controller is programmable to cause the prime mover to rotate the shaft for a first time interval at a lower speed to provide a lower rate of movement of the materials through the opening between the zones and a longer dwell time of processing of the materials within the zones and to rotate the shaft for a second time interval at a higher speed than the lower speed to provide a higher rate of movement of the materials through the opening between the zones and a shorter dwell time of processing of the materials within the zone. Alternatively, the controller is programmable to cause the prime mover to rotate the shaft at a set speed to provide a continuous rate of processing and movement of the materials through the opening between zones.

BEST MODE FOR CARRYING OUT THE INVENTION

Figure 1:
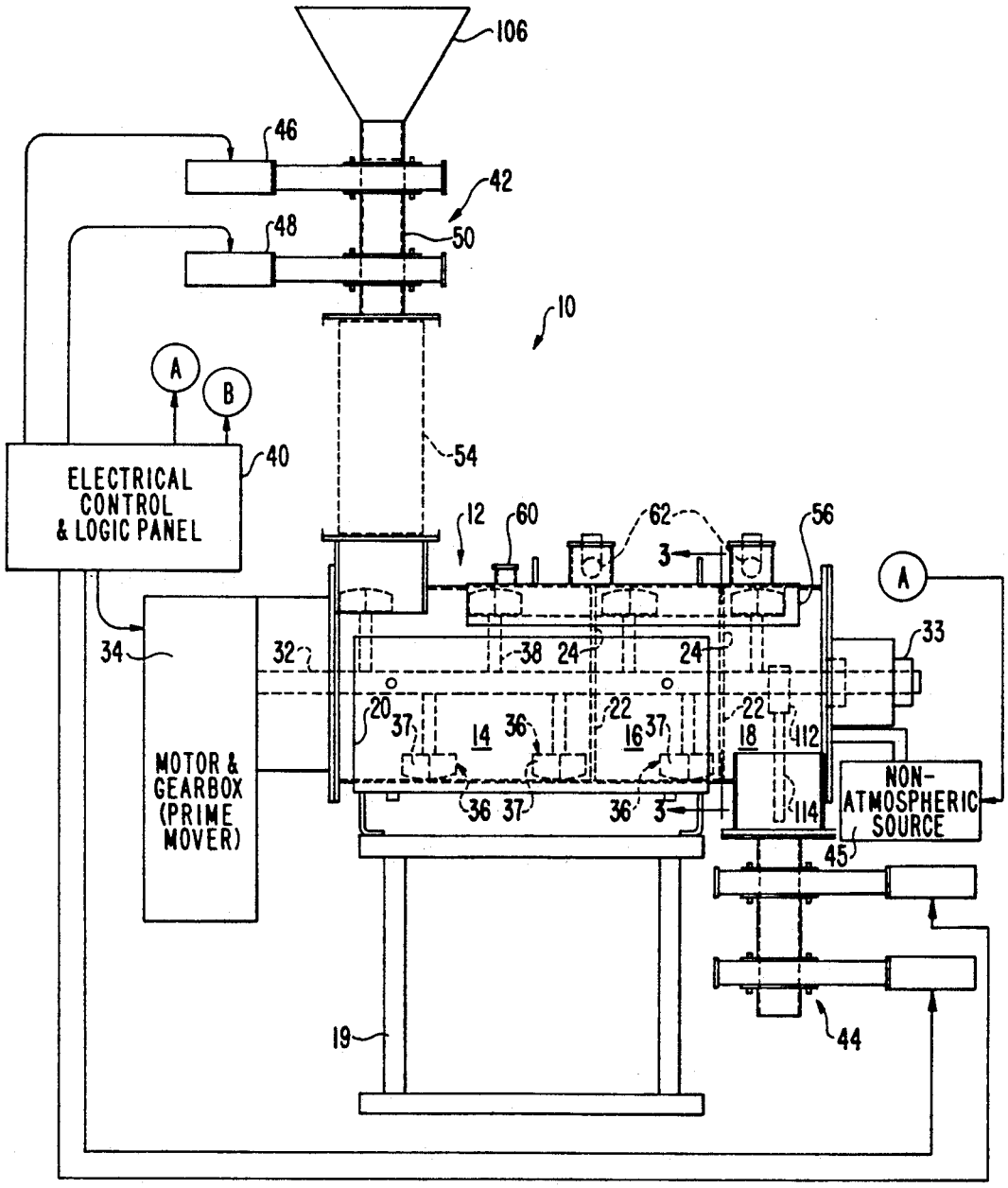
FIG. 1 illustrates a front elevational view of the present invention.
Figure 2:
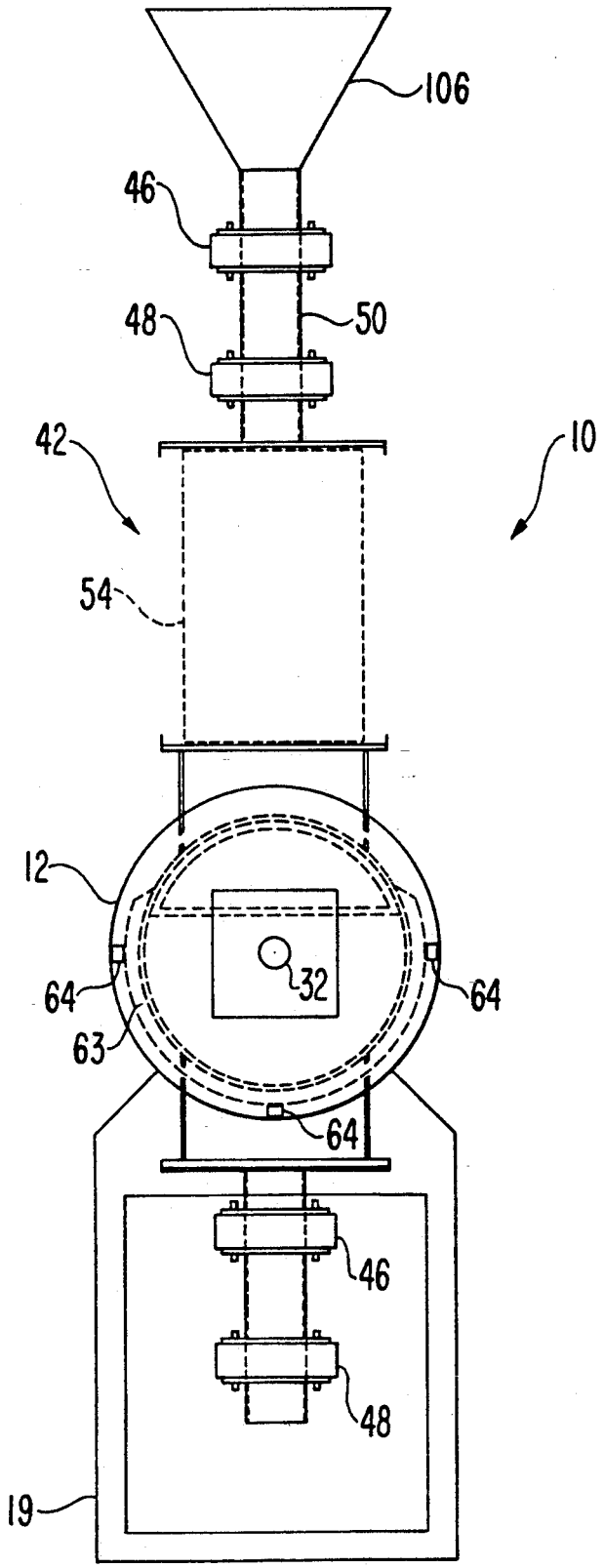
FIG. 2 illustrates a side elevational view of the present invention.
Figure 3:
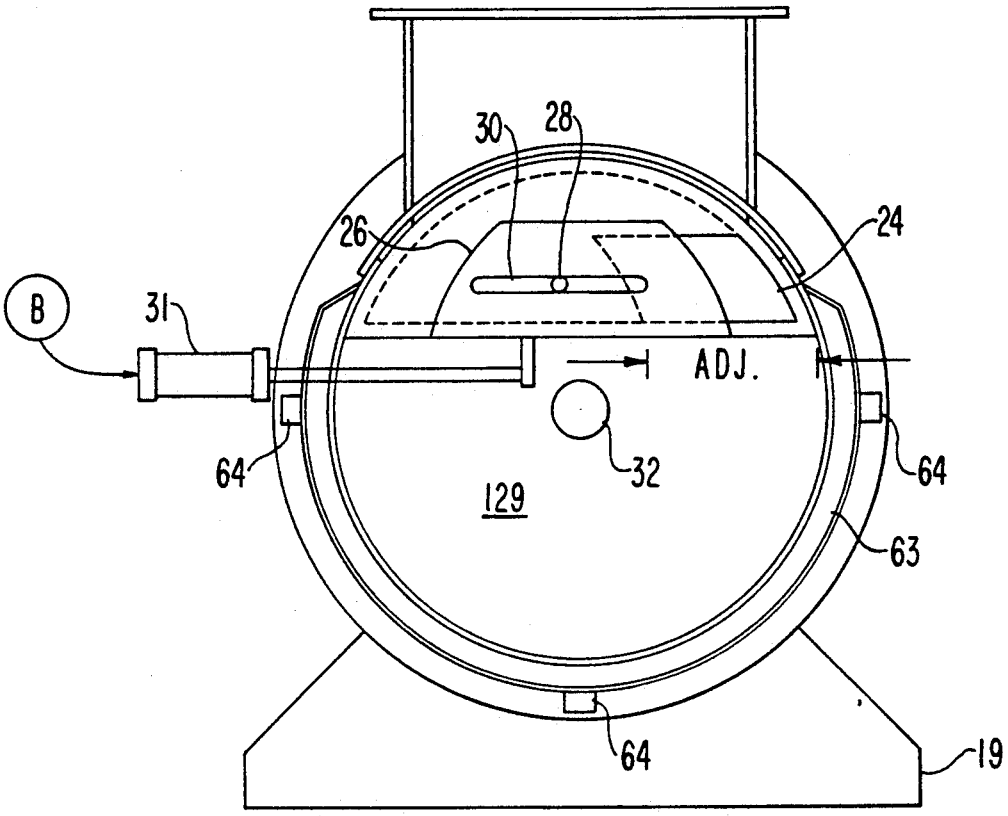
FIG. 3 illustrates a sectional view of FIG. 1.

FIGS. 1-3 illustrate an apparatus 10 for continually processing liquids and/or solids (materials) including mixing, drying or reacting in accordance with the invention. A chamber 12 is used for performing the processing of materials by the present invention. The chamber 12 is comprised of a plurality of zones 14, 16, 18 which may be varied in number and dimension depending upon the particular application and the degree of processing required. The apparatus is supported by a stand 19. The zones 14, 16, 18 are defined by an inner wall 20 of the chamber 12 and a weir 22 which is disposed at a boundary between zones within the chamber. An opening 24 extends vertically upward from the weir 22 between adjacent zones within the chamber 12 for permitting the materials to pass from one zone to an adjacent zone. The opening may be produced by a manually adjustable gate 26 which slides horizontally to permit adjustment of the opening 24. FIG. 3 illustrates an end view of the opening 24. A handle 28 slides within slot 30 for guiding the gate 26. Actuator 31, may optionally be added to power the movement of the gate 26 from power supplied from an external source which may be electric or a fluid source under the control of the controller 40 described below. A shaft 32 is driven by a motor and gear box (prime mover) 34 for rotating a series of elements 36 which are connected to the shaft by radially extending members 38. The shaft 32 is rotatably supported by bearings 33. The elements 36 contact the material within the zones 14, 16, 18 to promote mixing, drying or reacting, etc., of the materials within the zones. The elements 36 may have differing shapes in accordance with the prior art teachings of promoting agitation, mixing, drying and reactions by moving material contacted by moving elements. The design, number and orientation of the mixing elements 36 within each of the zones 14, 16, 18 is varied to control retention time of the mater within the zones. Contacting of the elements 36 with the materials within the zones controls the rate of movement of the material through the opening 24 between the zones and axially within a zone. Each of the elements 36 typically will have substantial surface area 37 which is inclined with respect to the axis of rotation of the shaft 32 to provide a plow-like function to move the material axially within the zone toward the opening 24.

Increasing of the rate of rotation of the shaft imparts additional, energy to the materials within each of the zones 14, 16, 18 which increases the rate of movement of the materials through the opening 24 between the zones and decreasing the rate of rotation decreases the rate of movement of materials through the opening. Additionally, the opening 24 between adjacent zones may be adjusted to be larger to increase the rate of movement of materials through the opening and may be adjusted to be smaller to decrease the rate of movement of materials through the opening.

A programmed controller 40, having an electrical control and logic panel, which may be in the form of a programmed control logic, controls the operation of the various components in the system including the rate of rotation of the shaft 32 produced by the prime mover 34. The programmed controller 40 may be programmed to control a rate of rotation of the shaft by the prime mover 34 to produce programmed contact of the elements 36 with the materials within the zones 14, 16, 18 a programmed rate of movement of the materials through the opening 24 between the zones and axially within a zone and a programmed dwell time of materials within each zone. The controller is programmable to cause the prime mover 34 rotating the shaft 32 for a first time interval at a lower speed to provide a lower rate of movement of the materials through the opening 24 between zones 14, 16, 18 a longer dwell time of processing of the materials within the zones and to rotate the shaft for a second time interval at a higher speed than the lower speed to provide a higher rate of movement of the materials through the opening between the zones and a shorter dwell time of processing of materials within the zone. Alternatively, the controller 40 is programmable to cause the prime mover to rotate the shaft at a set speed to provide a continuous rate of processing and movement of materials through the opening between zones. The controller 40 may be implemented in any programmable device including a microprocessor or other programmable analog or digital device. The controller 40 includes a memory (not illustrated) for storing a plurality of different programs used for processing different materials which provides the ability to choose stored programs to economically process diverse types of materials without substantial manual overhead, especially when the controller controls all of the variable elements within the apparatus as described below.

A material input 42 controls the flow of materials to be processed by the apparatus and controls the addition of the materials into the first zone 14 and a material output 44 controls the flow of materials which has been finally processed in the final processing zone 18 from the apparatus. Both the material input and the material output 42 and 44 are atmospherically sealed to the chamber 12 with seals (not illustrated) so that non-atmospheric conditions may be provided within the material input, the material output and inside of the chamber during processing. A non-atmospheric pressure source 45 is coupled to the interior of the chamber 12 at one or more of the zones 14, 16, 18 or to the material input 42 or material output 44 to provide either a vacuum to promote drying and the removal of other vapors within the materials being processed or pressurization with gas used for processing materials within the chamber such as during chemical reactions within the chamber. The material input 42 and the material output 44 are provided with valving to control the addition of materials for processing within the chamber and the removal of processed materials from the chamber while maintaining non-atmospheric pressure. The valving in the material input 42 and the material output 44 may be a pair of valves 46 and 48 which are connected in series in conduit within the material input 42 and the material output 44.

Figure 1A:
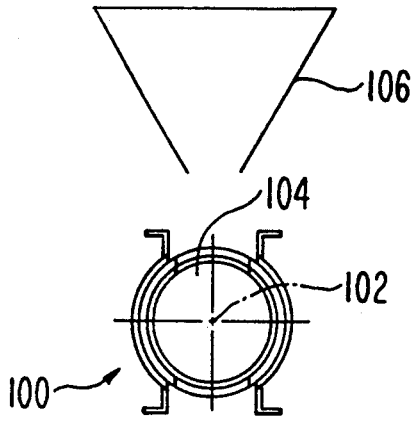
FIG. 1A illustrates a rotary airlock which may be used as alternative valving in the embodiment of FIG. 1.

Alternatively, the valving may be a rotary airlock valve 100 as illustrated in FIG. 1A. The rotary airlock 100 is rotated about axis 102 which is perpendicular to the axis of the conduit 50. When used in the material input 42 the open section 104 collects materials when the rotary airlock 100 is in the position as illustrated under the control of controller 40 at which the materials within the section are maintained at atmospheric pressure. The rotary airlock 100 is rotated 180° under control of the controller 40 to cause the materials to be discharged into the conduit 50 while sealing the conduit from the atmosphere and the hopper 106. The rotary airlock 100 in the material output is operated in an analogous manner to output materials from the final stage 18 while maintaining a seal from the atmosphere at all times by rotation through successive 180° rotations.

The valves 46 and 48 may be of diverse form including, but not limited to, slide gate valves as illustrated or ball or butterfly valves, etc. In order to control the pressure within the chamber 12 at non-atmospheric pressure, the valves 46 and 48 are operated under the control of the controller 40 to control movement of the materials through the material input 42 into the first zone 14.

The lower valve 48 in the material input 42 is controlled by the controller 40 to be closed while the upper valve 46 is controlled by the controller 40 to be open to seal the chamber 12 from atmospheric pressure and the hopper 106 during conveying of materials by the material input for addition to the first zone 14. Thereafter, the upper valve 48 is closed by the controller 40 to seal the materials conveyed by the material input from atmospheric pressure between the upper and lower valves. Finally, the lower valve 48 is opened by the controller 40 to cause the materials between the lower and upper valves to be added to the first zone 14. The above-described sequence of operation of the valves in the material output 42 is repeated cyclically during the continuous processing performed by the invention.

The lower valve 48 in the material output 44 is controlled by the controller 40 ,to be closed while the upper valve 46 in the material output is opened during discharge of materials from the last zone 18. Thereafter, the upper valve 46 in the material output 44 is closed by the controller 40 to seal the discharged materials between the valves from atmospheric pressure. Finally, the lower valve 48 is opened to cause the materials between the lower and upper valves 46 and 48 of the material output 44 to be moved between the valves typically by the effect of gravity. The above-described sequence of operation of the valves in the material output 44 is repeated cyclically during the continuous processing produced by the present invention. Vacuum, pressure or vibrating devices can be added to aid in the charging or discharging of the valves.

Figure 6:
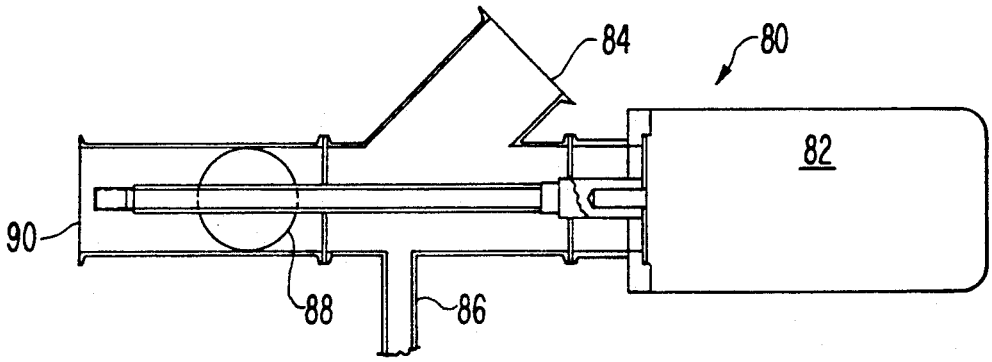
FIG. 6 is an elevational view of agglomeration section which may be placed within the material input.

The material input 42 may contain miscellaneous processing equipment 51 such as, but not limited to, an agglomerating device for spraying liquid into powder introduced into hopper 106 to produce agglomeration of the powder or a high intensity agitator for purposes of predispersion of minor ingredients prior to introduction into the first zone 14 of the chamber 12. FIG. 6 described below illustrates an agglomerating device which may be disposed within the material input 42.

Figure 7:
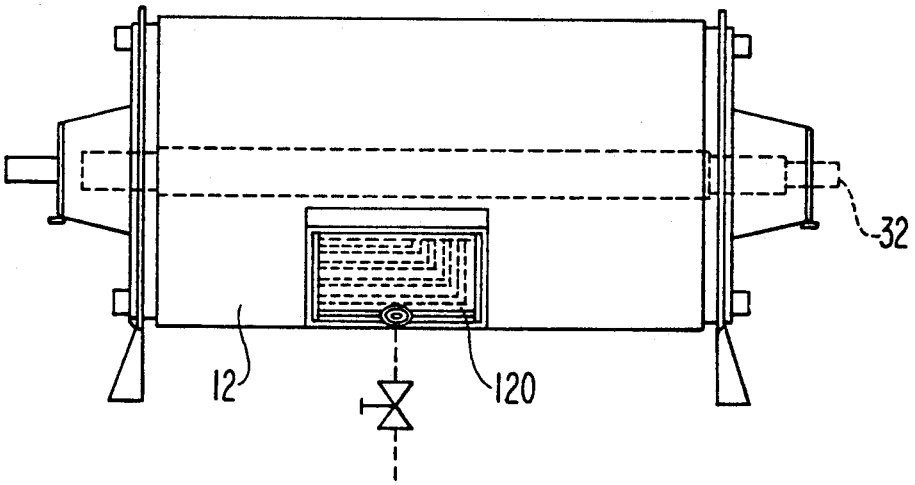
FIGS. 7 and 7A are views of a filtration screen which may be placed in one or more zones of the chamber to provide for separation of liquid within the chamber from solids being processed therein.
Figure 7A:
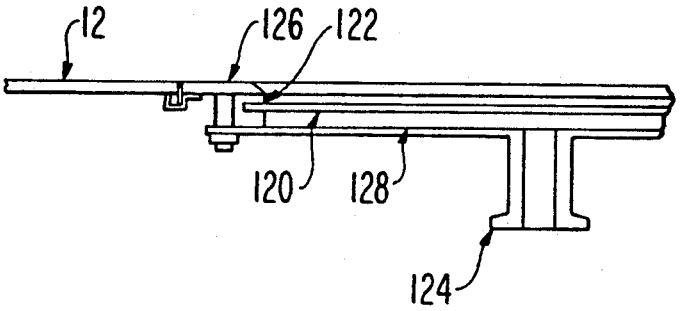

The chamber 12 contains the following additional structures. A removable lid 56 is mounted in the top section of the chamber 12 to permit access to each of the zones 14, 16, 18 including adjustment of the openings 24. A filtration screen may be disposed in one or more of the zones 14, 16, 18 in either the bottom or in the side of the chamber 12 for permitting liquid separation of liquids and solids disposed within the zones by liquid flowing through the screen outside the chamber. FIGS. 7 and 7A described below illustrates a sectional view of the filtration screen including the interior portion within the chamber 12 and the exterior portion. The filtration screen is periodically back-flushed during operation to prevent accumulation of excessive solids from occluding (blinding) the screen which would interfere with draining of liquid from the chamber when the invention is being used to filtrate materials containing undesired liquid components through the filtration screen. Viewing ports 60 may be disposed in the side walls of the chamber 12 to permit visualization of the processing within the chamber 12. Additionally, spray balls 62 may be installed to permit cleaning of the interior of the chamber 12 between processings.

A jacket 63 may be provided in contact with the inner wall 20 of the chamber 12 and/or a jacket 129 in contact with the weir(s) 22 and/or a hollow shaft 32 (not illustrated) for receiving cooling or heating fluids for controlling the temperature within the chamber for a suitable fluid source (not illustrated). A plurality of fluid ports 64 are provided for coupling fluid to the jacket and outputting fluid from the jacket from the fluid source. Heated fluid may be coupled to the jacket 63 to heat the chamber 12 to promote drying of product which is typically conducted under sub-atmospheric pressure. Cooling fluid may be coupled to the jacket 63 to cool the chamber 12 to absorb heat generated by exothermic chemical reactions taking place within the zones 14, 16, 18. Diverse types of heating and cooling fluids may be utilized in conjunction with the jacket 63 to provide precise control of temperature conditions within the chamber 12. For example, the jacket 63 may be sectorized (not illustrated) such that each processing zone 14, 16, 18 is thermally coupled to a single jacket which receives fluid having the required temperature for processing the materials within the processing zone coupled to the jacket sector. Other means of introducing heating, such as gasses, infrared or microwave (not illustrated) may be used for thermal treatment.

The material output 44 may include an agitator 110 disposed within the final zone 18 for contacting the material to cause the material to flow into the material output. The agitator may include an eccentric 112 mounted on the shaft 32. A member 114 is connected to the eccentric which extends into the material output 44 with rotation of the eccentric causing the member to reciprocate within the material output. As a result, any tendency of a finally processed solid to agglomerate or bridge is reduced to provide a uniform flow rate of finally processed material from the material output 44. Vibrators or air pads may also be used in the material movement through the input and output devices 42 and 44.

Figure 4:
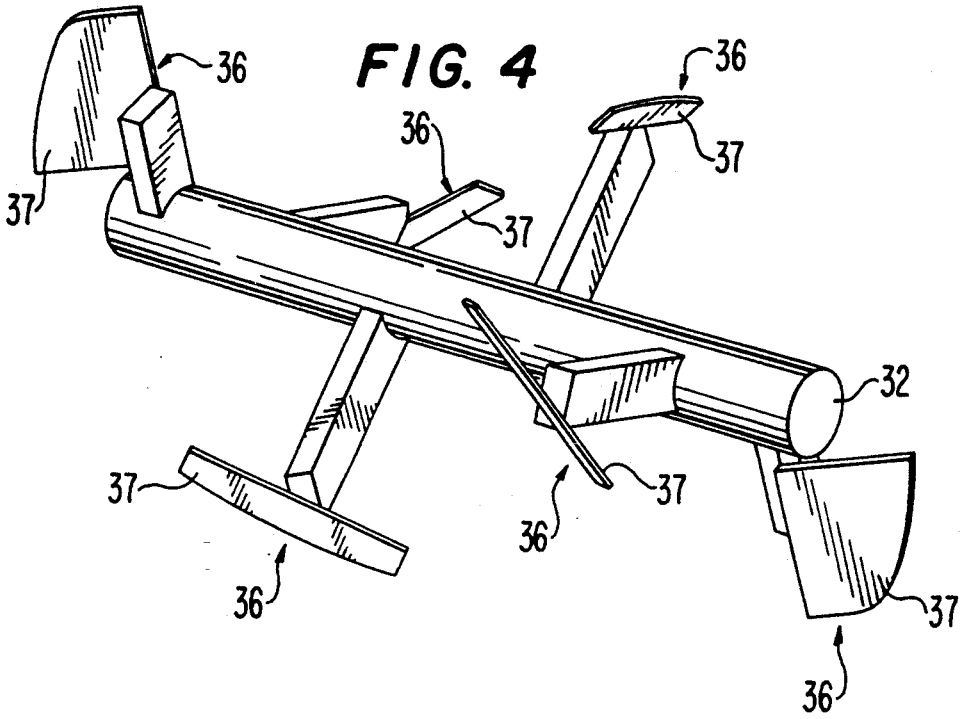
FIG. 4 is a view illustrating the elements mounted on the shaft extending axially through the chamber.

FIG. 4 illustrates a perspective view illustrating the elements 36 mounted on the members 38 which are attached to the shaft 32. Like reference numerals identify like parts in FIGS. 1–4. The individual elements have a surface 37 which is transverse to the axis of rotation of the shaft 32 to impart an axial component of motion of the materials being processed in each of the sections 14, 16, 18 toward the opening 24 between adjacent sections. As a result, rotation of the shaft at a slower velocity results in a lesser quantity of materials being transferred through the opening 24 with it being possible to rotate the shaft at a low enough velocity such that substantially no materials are transferred between adjacent zones. When the controller 40 increases the rotational velocity of the shaft 32, the surface 37 of the elements 36 which is transverse to the shaft 32 imparts additional axial movement to the materials being processed within a zone. The rotational velocity of the shaft 32 may be made high enough so that the surface 37 of the element 36 which is transverse to the axis of rotation of the shaft 32 imparts sufficient velocity to the materials to rapidly force the materials through the opening 24. As is apparent, the rate of transfer of materials between zones 14, 16, 18 is readily controllable by the choice of the rotational velocity of the shaft 32, the slope of the surface 37 of the element 36 inclined to the axis of rotation of the shaft, the number of elements 36 within a zone and the cross sectional area of the opening 24 between adjacent zones.

Figure 5:
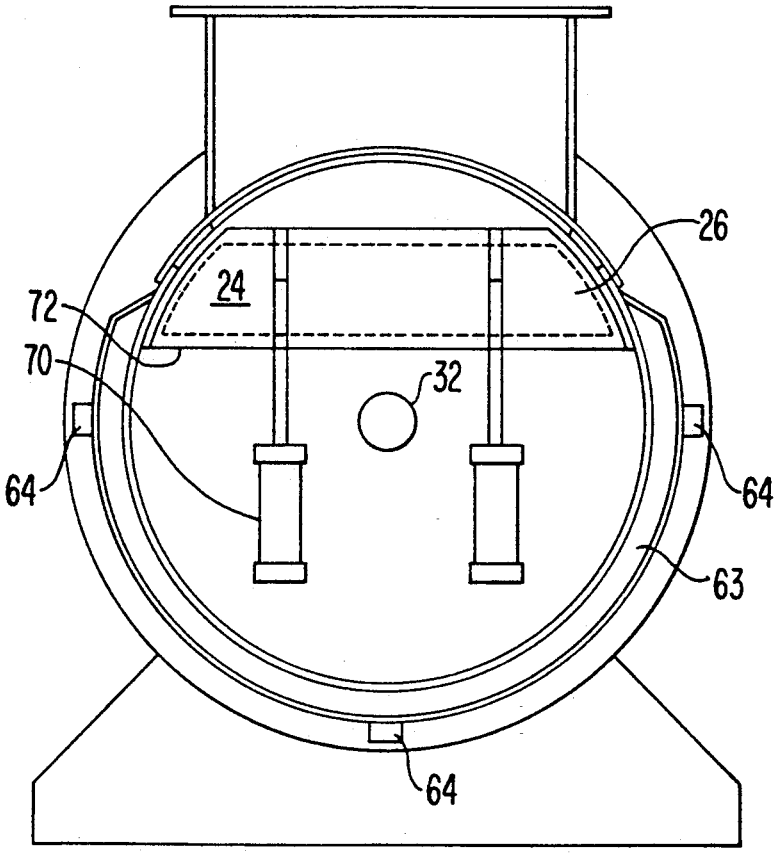
FIG. 5 is a sectional view of a remotely controlled gate defining the opening between processing zones into the final zone of the chamber.

FIG. 5 illustrates an alternative embodiment of the gate 26 controlling the opening 24 between adjacent zones opening into the final zone 18. The gate 26 is externally activated by a control associated with the controller 40. Fluid powered cylinders 70 pivot the gate 26 about an axis 72 which is perpendicular to the axis of rotation of the shaft 32. As materials are forced into the last processing zone 18, it falls through the opening from the last processing zone into the conduit 50 of the material output 44 without bridging on the actuators 70. It should be further understood that other configurations of externally powered gate adjusting controls may be utilized in practicing the invention which may be either manually or powered by an external energy source such as, but not limited to, pressurized fluid. As has been stated above, the adjustability of the opening 24 by either the gate illustrated in FIG. 3, which is adjusted by removal of the lid 56 or remotely from the control panel of the controller 40 under the power of actuator 31 or 70, provides substantial control over the dwell time of materials within each of the processing stages 14–18.

FIG. 6 illustrates an elevational view of a agglomeration section 80 which may be disposed in the miscellaneous processing equipment section 54 of the material input 42. The agglomeration section 80 is comprised of an adjustable speed electric motor 82, a shaft driven agitator with elements (not illustrated) mounted on the shaft to agitate materials passing from the inlet 84 which is downstream from valve 48, a liquid addition nozzle 86 which is connected to a suitable source of liquid (not illustrated) which is sprayed into contact with powder which is added by powder inputted through inlet 84 to cause agglomeration of the powder. An air injection manifold 88 may be coupled to the agglomeration section 80 for providing warm, dry air to promote drying of the powder which is agglomerated. As a consequence of the agglomeration section 80 being downstream from the valves 46 and 48 which maintain the seal between the interior of the chamber and the atmosphere, it is possible to control the processing pressure under which the agglomeration takes place.

FIGS. 7 and 7A illustrate an elevational view and a sectional view of the filtration screen 120 which is disposed in the bottom of the chamber 12 in one or more of the processing zones 14, 16, 18. The details of the chamber and other structures of FIG. 1 have been omitted. The filtration screen 120 has a fluid seal 122 with the wall of the chamber 12 such that fluid only runs out through the screen through the manifold 124. Filtration panel 126 fits in the opening in the wall of the chamber 12 from the inside. Outer closure 128 closes the opening in the wall of the chamber 12 from the outside. The fluid manifold 92 may be used for providing liquid for back flushing the screen 58 to remove occlusion (blinding) which otherwise would prevent the continued draining of liquid from the processing zones after solid material has collected in the opening between the parts of the screen.

EXAMPLES

Some of the material tested was wet pigment which consisted of extremely fine particles for purposes of demonstrating variation in processing parameters produced by variation in speed of the shaft 32.

It was determined that the movement of materials between zones through the opening 24 stopped when the speed of rotation of the shaft 32 was equal to or less than 15% of the top speed of the prime mover 34 for a particular configuration of the invention.

When speed of the shaft 32 increased to 20% of top speed of the prime mover 34, the rate of discharge started at 0.19 ppm (pounds per minute) and increased to approximately 1 ppm with an average of 0.364 ppm.

The charging rate was 34 pounds over 30 minutes for a rate of 1.13 ppm. The charging rate may be substantially increased or decreased depending on the dwell time required and the size of the machine used.

The speed of the shaft was increased from 20% to 25% of full speed of the prime mover 34 with a dwell time of 120 seconds being observed within the chamber 12. The rate of discharge started at 0.52 ppm and increased to an average of 0.88 ppm.

The speed of the shaft 32 was maintained at 25% of top speed of the prime mover 34 which resulted in an observed dwell time of 180 seconds of the particles within the chamber. A rate of discharge started at 0.74 ppm and averaged at 0.6 ppm. The pigment had an initial moisture content of 9% which was reduced to 0% after being processed.

The speed of the shaft 32 was maintained at 25% of top speed of the prime mover 34 which produced an observed dwell time of 120 seconds of the pigment within the chamber with a rate of discharge starting at 0.71 ppm which decreased to 0.11 ppm and started to increase to 0.55 ppm when the product which was fed was adjusted from 11% moisture at the start to 6% moisture during continual processing.

It was further determined that the flow of pigment must be free flowing in the feed hoppers or the pigment may cake-up and block the hopper. This problem was solved by using a positive feed screw which prevented excess material in the feed hopper. Additionally, an agitated feed hopper may be used to avoid material compaction and blockage.

It was determined as a result of the aforementioned tests that for a set opening 24 between the zones 14, 16, 18, 15% of the top speed of the prime mover 34 resulted in the interruption of flow between zones which prevented material short circuiting by migration of the pigment to the material output 44. Increases in shaft speed increased the transport speed of material between zones. The capability of the present invention to provide material transport of shorter or longer dwell as a function of various parameters including the size of the opening 24 between zones, the rate of rotation of the shaft 22, the design of the elements 26 and the physical characteristics of the material being processed provides diverse processing capability with diverse types of materials. Furthermore, this processing may be conducted under non-atmospheric conditions by the utilization of the valving described above.

While the invention has been described in terms of its preferred embodiment, it should be understood that numerous modifications may be made thereto without departing from the spirit and scope of the invention as defined in the pending claims. For example, it should be noted that the number of processing zones and the overall size of various components may be varied while practicing the invention. Furthermore, the invention provides a frame to which additional processing apparatus may be attached which provides a compact sized multiple function processing apparatus. Furthermore, the invention may be connected in series or parallel with other pieces of processing equipment to provide additional processing capability. The invention may be practiced with the interior of the chamber 12 maintained at atmospheric pressure which does not require the valving in the material input 42 and material output 44 or alternatively with the valving controlled under the control of the controller 40 to provide isolation of atmospheric pressure from the interior of the chamber. Vacuum conditions may be used to promote drying while pressure conditions above normal atmospheric pressure may be used to promote various chemical reactions. The jackets 63 and 129 and the hollow screw 32 may be used to increase or decrease the temperature of processing in accordance with the desired application to provide for diversified processing such as simple drying or reacting of components which produces exothermic chemical reactions. It is intended that all such modifications fall within the scope of the appended claims.

I claim:

1. An apparatus for continuously processing materials including mixing, drying or reacting, comprising:

a chamber containing a plurality of axially separated processing zones in which zones the materials are accommodated and processed and, after processing, the materials are axially moved between the zones, the zones being defined by an inner wall of the chamber and at least one weir with a weir being disposed at a boundary between zones within the chamber, and a selectively openable opening extending vertically upward from the weir within the chamber for permitting the materials to pass from one zone to an adjacent zone only after the materials are processed in the respective zones;

a shaft extending through the zones having a plurality of radially extending elements for contacting the materials within the zones with rotation of the shaft causing the materials within the zones to be contacted by the elements and axially passed through the opening between zones;

a prime mover for for rotating the shafts; and a controller for controlling the speed of rotation of the shaft by the prime mover for controlling contact of the elements with the materials and rate of movement of the materials through the opening between the zones and axially within a zone.

2. An apparatus in accordance with claim 1 further comprising:

a material input for controlling feeding of materials into a first zone of the chamber which receives the materials with the elements contacting the materials in the first zone to perform initial processing of the materials within the chamber; and a material output for controlling the feeding of materials from a final zone in the chamber in which the elements contact the materials to perform final processing of the materials within the chamber.

3. An apparatus in accordance with claim 2 wherein the material input further comprises:

an apparatus for agglomerating solids flowing through the material input.

4. An apparatus in accordance with claim 1 wherein:

the opening between zones comprises a gate having a movable member which is moved by an adjustment mechanism to vary a cross section of the opening between adjacent zones.

5. An apparatus in accordance with claim 1 wherein the chamber further comprises:

a removable lid which when removed exposed the zones; and wherein an adjustment mechanism is disposed within the chamber and a cross section of the opening is moved by a member within the chamber which is moved by access through the removed lid.

6. An apparatus in accordance with claim 1 further comprising:

a packet surrounding at least a part of one of the chambers or the weirs for receiving fluid for controlling temperature of the chamber and/or the weirs.

7. An apparatus in accordance with claim 1 further comprising:

at least one fluid spraying device maintained in a wall of the chamber for spraying fluid inside the chamber for spray cleaning fluid within the chamber.

8. An apparatus in accordance with claim 1 wherein:

the chamber is cylindrical with the shaft being mounted axially within the chamber.

9. An apparatus in accordance with claim 1, further comprising:

an agitator disposed within the final zone for contacting the materials to cause the materials to flow into the material output.

10. An apparatus for continuously processing materials including mixing, drying or reacting, comprising:

a chamber containing a plurality of axially separated processing zones in which the materials are accommodated and processed and through which the materials are axially moved between the zones, the zones being defined by an inner wall of the chamber and at least one weir with a weir being disposed at a boundary between zones within the chamber, and an opening extending vertically upward from the weir within the chamber for permitting the materials to pass from one zone to an adjacent zone;

a shaft extending through the zones having a plurality of radially extending elements for contacting the materials within the zones with rotation of the shaft causing the materials within the zones to be contacted by the elements and axially passed through the opening between zones;

a prime mover for rotating the shafts;

a controller for controlling the speed or rotation of the shaft by the prime mover for controlling contact of the elements with the materials and rate of movement of the materials through the opening between the zones and axially within the zone;

a material input for controlling feeding of materials into a first zone of the chamber which receives the materials with the elements contacting the materials in the first zone to perform initial processing of the materials within the chamber; and a material output for controlling the feeding of materials from a final zone in the chamber in which the elements contact the materials to perform final processing of the materials within the chamber; and wherein the material input and the material output respectively comprise a pair of valves coupled in series in the material input and in the material output and the pair of valves in the material input are opened and closed under control of the controller to control movement of the materials through the material input into the first zone and the pair of valves in the material output are opened and closed under control of the controller to control movement of materials from the final zone.

11. An apparatus in accordance with claim 10 wherein the material input further comprises:

an apparatus for agglomerating solids flowing through the material input.

12. An apparatus in accordance with claim 10 wherein:

the chamber and the materials input and material output are sealed to maintain non-atmospheric pressure within the chamber, the material input and the material output; and further comprising;

a source of non-atmospheric pressure coupled to the chamber for maintaining the chamber at non-atmospheric pressure during processing of materials within the chamber; and a lower valve in the material input is controlled by the controller to be closed while an upper valve in the material input is controlled by the controller to be open to seal the chamber from atmospheric pressure during conveying of materials by the material input for addition to the first zone, thereafter the upper valve is closed by the controller to seal the material conveyed by the material input from atmospheric pressure between the lower and upper valves and thereafter the lower valve of the material input is opened by the controller to cause the material between the lower and upper valves to be added to the first zone.

13. An apparatus in accordance with claim 3 wherein:

the chamber and the material input and material output are sealed to maintain non-atmospheric pressure within the chamber, the material input and the material output; and further comprising;

a source of non-atmospheric pressure coupled to the chamber for maintaining the chamber at non-atmospheric pressure during processing of materials within the chamber; and a lower valve in the material output is controlled by the controller to be closed while the upper valve in the material output is opened during discharge of materials from the last zone, thereafter the upper valve in the material output is closed by the controller to seal the discharged materials between the valve from atmospheric pressure and thereafter the lower valve of the material output is opened to cause the materials between the lower and upper valves to be moved from between the valves.

14. An apparatus for continuously processing materials including mixing, drying or reacting, comprising:

a chamber containing a plurality of axially separated processing zones in which the materials are accommodated and processed and through which the materials are axially moved between the zones, the zones being defined by an inner wall of the chamber and at least one weir with a weir being disposed at a boundary between zones within the chamber, and an opening extending vertically upward from the weir within the chamber for permitting the materials to pass from one zone to an adjacent zone;

a shaft extending through the zones having a plurality of radially extending elements for contacting the materials within the zones with rotation of the shaft causing the materials within the zones to be contacted by the elements and axially passed through the opening between zones;

a primer mover for rotating the shafts;

a controller for controlling the speed of rotation of the shaft by the prime mover for controlling contact of the elements with the materials and rate of movement of the materials through the opening between the zones and axially within the zone;

a material input for controlling feeding of materials into a first zone of the chamber which receives the materials with the elements contacting the materials in the first zone to perform initial processing of the materials within the chamber; and a material output for controlling the feeding of materials from a final zone in the chamber in which the elements contact the materials to perform final processing of the materials within the chamber; and wherein the material input and material output respectively comprise a rotary airlock controlled by the controller with the rotary airlock in the material input controlling movement of the materials through the material input into the first zone and the rotary airlock in the material output controlling movement of the materials from the final zone.

15. An apparatus in accordance with claim 14 wherein the material input further comprises:

an apparatus for agglomerating solids flowing through the material input.

16. An apparatus in accordance with claim 14 wherein:

the chamber and the material input and material output are sealed to maintain non-atmospheric pressure within the chamber, material input and material output; and further comprising;

a source of non-atmospheric pressure coupled to the chamber for maintaining the chamber at non-atmospheric pressure during processing of materials within the chamber; and the rotary airlock of the material input is rotated by the controller to retain materials within the material input while the materials are coupled to atmospheric pressure and the material input between the rotary airlock and the first zone is at non-atmospheric pressure and the rotary airlock of the material input is rotated by the controller to convey the materials to the material input between the rotary airlock and the first zone while sealing the material input between the airlock and the first zone from atmospheric pressure.

17. An apparatus in accordance with claim 14 wherein:

the chamber and the material input and material output are sealed to maintain non-atmospheric pressure within the chamber, material input and material output; and further comprising;

a source of non-atmospheric pressure coupled to the chamber for maintaining the chamber at non-atmospheric pressure during processing of liquids or solids within the chamber; and the rotary airlock of the material output is rotated by the controller to retain materials within the material output while the material output between the final zone and the rotary airlock of the material output is coupled to non-atmospheric pressure and the rotary airlock of the material output is rotated by the controller to convey materials within the rotary airlock of the material output to atmospheric pressure while sealing the material output between the final zone and the rotary airlock of the material output to non-atmospheric pressure.

18. An apparatus for continuously processing materials including mixing, drying or reacting, comprising:

a chamber containing a plurality of axially separated processing zones in which the materials are accommodated and processed and through which the materials are axially moved between the zones, the zones being defined by an inner wall of the chamber and at least one weir with a weir being disposed at a boundary between zones within the chamber, and an opening extending vertically upward from the weir within the chamber for permitting the materials to pass from one zone to an adjacent zone the opening between zones comprises a gate having a movable member which is moved by an adjustment mechanism to vary a cross section of the opening between adjacent zones;

a shaft extending through the ones having a plurality of radially extending elements for contacting the materials within the zones with rotation of the shaft causing the materials within the zones to be contacted by the elements and axially passed through the opening between zones;

a prime mover for rotating the shafts;

a controller for controlling a speed of rotation of the shaft by the prime mover for controlling contact of the elements with the materials and rate of movement of the materials through the opening between the zones and axially within a zone; and an adjustment mechanism disposed within the chamber, wherein the adjustment mechanism comprises an actuator which receives energy from outside the chamber with the movable member being moved by operation of controls disposed outside the chamber.

19. An apparatus for continuously processing materials including mixing, drying or reacting, comprising:

a chamber containing a plurality of axially separated processing zones in which the materials are processed and through which the materials are axially moved between the zones, the zones being defined by an inner wall of the chamber and at least one weir with a weir being disposed at a boundary between zones within the chamber, and an opening extending vertically upward from the weir within the chamber for permitting the materials to pass from one zone to an adjacent zone;

a shaft extending through the zones having a plurality of radially extending elements for contacting the materials within the zones with rotation of the shaft causing the materials within the zones to be contacted by the elements and axially passed through the opening between zones;

a prime mover for rotating the shafts;

a controller for controlling a speed of rotation of the shaft by the prime mover for controlling contact of the elements with the materials and rate of movement of the materials through the opening between the zones and axially within a zone; and a filtration screen disposed in a section of at least one of the zones for permitting liquid separation of liquid from solids disposed within the zones by liquid flowing through the screen to outside the chamber.

20. An apparatus for continuously processing materials including mixing, drying or reacting, comprising:

a chamber containing a plurality of axially separated processing zones in which the materials are processed and through which the materials are axially moved between the zones, the zones being defined by an inner wall of the chamber and at least one weir with a weir being disposed at a boundary between zones within the chamber, and an opening extending vertically upward from the weir within the chamber for permitting the materials to pass from one zone to an adjacent zone;

a shaft extending through the zones having a plurality of radially extending elements for contacting the materials within the zones with rotation of the shaft causing the materials within the zones to be contacted by the elements and axially passed through the opening between zones;

a prime mover for rotating the shafts;

a controller for controlling a speed of rotation of the shaft by the prime mover for controlling contact of the elements with the materials and rate of movement of the materials through the opening between the zones and axially within a zone;

a material input and material output, said material input, material output and said chamber are sealed to maintain non-atmospheric pressure within the chamber, material input and material output; and a source of non-atmospheric pressure coupled to the chamber for maintaining the chamber at non-atmospheric pressure during processing of liquids or solids within the chamber.

21. An apparatus for continuously processing materials including mixing, drying or reacting, comprising:

a chamber containing a plurality of axially separated processing zones in which the materials are processed and through which the materials are axially moved between the zones, the zones being defined by an inner wall of the chamber and at least one weir with a weir being disposed at a boundary between zones within the chamber, and an opening extending vertically upward from the weir within the chamber for permitting the materials to pass from one zone to an adjacent zone;

a shaft extending through the zones having a plurality of radially extending elements for contacting the materials within the zones with rotation of the shaft causing the materials within the zones to be contacted by the elements and axially passed through the opening between zones;

a prime mover for rotating the shafts;

a controller for controlling a speed of rotation of the shaft by the prime mover for controlling contact of the elements with the materials and rate of movement of the materials through the opening between the zones and axially within a zone;

an agitator disposed within the final zone for contacting the materials to cause the materials to flow into the material output, and wherein the agitator comprises an eccentric rotatably mounted on the shaft which is connected to a member extending into the material output with rotation of the eccentric causing the member to reciprocate within the material output.

22. An apparatus for continuously processing materials including mixing, drying or reacting, comprising:

a chamber containing a plurality of axially separated processing zones in which the materials are processed and through which the materials are axially moved between the zones, the zones being defined by an inner wall of the chamber and at least one weir with a weir being disposed at a boundary between zones within the chamber, and an opening extending vertically upward from the weir within the chamber for permitting the materials to pass from one zone to an adjacent zone;

a shaft extending through the zones having a plurality of radially extending elements for contacting the materials within the zones with rotation of the shaft causing the materials within the zones to be contacted by the elements and axially passed through the opening between zones;

a prime mover for rotating the shafts;

a controller for controlling a speed of rotation of the shaft by the prime mover for controlling contact of the elements with the materials and rate of movement of the materials through the opening between the zones and axially within a zone; and wherein the controller is programmable to provide a programmable processing of materials including control of a dwell time of the materials within each zone and a rate of movement of materials through the opening between zones.

23. An apparatus in accordance with claim 22 wherein:

the controller is programmable to cause the prime mover to rotate the shaft for a first time interval at a lower speed to provide a lower rate of movement of the materials through the opening between zones and a longer dwell time of processing of the materials within the zones and to rotate the shaft for a second time interval at a higher speed than the lower speed to provide a higher rate of movement of the materials through the opening between the zones and shorter dwell time of processing of the materials within the zone.

24. An apparatus in accordance with claim 22 wherein:

the controller is programmable to cause the prime mover to rotate the shaft at a set speed to provide a continuous rate of movement of the materials through the opening between zones.

25. An apparatus for processing materials including mixing, drying or reacting, comprising:

a cylindrical chamber containing a plurality of axially separated cylindrical zones in which zones the materials are accommodated and processed, and after processing the materials are axially moved between the zones, the zones being defined by an inner wall of the chamber and at least one weir with a weir being disposed at a boundary between zones within the chamber, and a selectively openable opening extending vertically upward form the weir within the chamber for permitting the materials to pass from one zone to an adjacent zone only after the materials are processed in the respective zones;

a shaft extending through the zones having a plurality of radially extending elements for contacting the materials within the zones with rotation of the shaft causing the materials within the zones to be contacted by the elements and axially passed through the opening between zones;

a prime mover for rotating the shaft; and a controller for controlling rotation of the shaft by the prime mover for controlling contact of the elements with the materials and movement of the materials through the opening between the zones and axially within a zone.

* * * * *